United States Patent [19]

Obikawa et al.

[11] 4,026,707

[45] May 31, 1977

[54] SILVER HALIDE PHOTOGRAPHIC EMULSION SENSITIZED WITH A MIXTURE OF OXACARBOCYANINE DYES

[75] Inventors: Tadahiko Obikawa; Shigemasa Itoh, both of Hino, Japan

[73] Assignee: Konishiroku Photo Industry Co., Ltd., Hino, Japan

[22] Filed: Aug. 12, 1976

[21] Appl. No.: 713,966

[30] Foreign Application Priority Data

Aug. 15, 1975 Japan ..... 50-99275
Aug. 19, 1975 Japan ..... 50-101018

[52] U.S. Cl. ..... 96/95; 96/56; 96/100; 96/109; 96/110; 96/124; 96/137

[51] Int. Cl.[2] ..... G03C 1/14

[58] Field of Search ..... 96/124, 100, 109, 56, 96/95, 110

[56] References Cited

UNITED STATES PATENTS

| | | | |
|---|---|---|---|
| 3,580,723 | 5/1971 | Sato et al. | 96/124 |
| 3,832,189 | 8/1974 | Shiba et al. | 96/124 |
| 3,854,955 | 12/1974 | Shiba et al. | 96/124 |

*Primary Examiner*—Travis Brown

[57] ABSTRACT

Silver halide supersensitized with a mixture of naphthoxazole and benzoxazole carbocyanine dyes.

26 Claims, No Drawings

SILVER HALIDE PHOTOGRAPHIC EMULSION SENSITIZED WITH A MIXTURE OF OXACARBOCYANINE DYES

This invention relates to a silver halide photographic emulsion, and more particularly to a silver halide photographic emulsion which has been improved so that no deterioration of the photographic characteristics of the green sensitive emulsion will take place during storage.

It is well known to add certain kinds of sensitizing dyes or coloring matters to silver halide for expanding the sensitive wavelength range of the silver halide photographic emulsion to allow sensitization to the visible range when so desired. Particularly, numerous devices have been made concerning the method for optically sensitizing the silver halide photographic emulsion by using a sensitizing dye or dyes. However, as it is well known, in case a sensitizing dye is added to the silver halide photographic emulsion, the various photographic properties such as anti-fogging performance, sensitivity and spectral sensitivity distribution, sensitivity stability or desensitizing effect as well as low or high intensity reciprocity law failure or developing performance are greatly affected by the conditions or manner of addition or structure of the sensitizing dye used. It is also known that addition of the sensitizing dye or dyes could cause changes of the photographic characteristics such as sensitivity, fogging or latent image keeping quality during preservation of the emulsion. As means for increasing green sensitivity of the silver halide photographic emulsion, there has been proposed a supersensitization method using a plurality of sensitizing dyes in combination. For instance, a combination of the sensitizing dyes revealed in Japanese Patent Publication No. 32753/1969 produces very excellent supersensitizing effect and, particularly, a high green sensitivity. Such combination, however, has problems in maintaining sensitivity during long-time storage or stability of density in the developing process after long-time preservation. Many other various combinations of sensitizing dyes have been attempted for improving supersensitizing effect, but many of such attempts are not necessarily satisfactory in stability of sensitivity during long-time preservation. It has been therefore an important subject to find out a means for realizing desired super-color sensitization without causing deterioration of the photographic characteristics during preservation of the silver halide photographic emulsion.

The object of this invention is to solve such problem, or in other words, to provide a green sensitive high-sensitivity silver halide photographic emulsion which has excellent supersensitizing properties and also remains substantially free of any elevation of fogging disposition or decrease of sensitivity during storage.

Thus, the present inventors have found that the aforesaid object can be accomplished by adding at least one of the sensitizing dyes expressed by the following general formula (I) and at least one of the sensitizing dyes expressed by the following general formula (II) in combination to the green-sensitive emulsion of the silver halide photographic sensitive compound:

General formula (I)

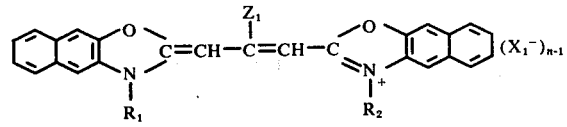

wherein $Z_1$ represents a methyl or ethyl group, $R_1$ and $R_2$ each represent a same or different alkyl group (such as methyl group or ethyl group) or sulfoalkyl group (such as 2-sulfoethyl group, 3-sulfopropyl group, 3-sulfobutyl group or 4-sulfobutyl group), $X_1^-$ represents acid anions, and $n$ represents and integer of 1 or 2, but $n$ is 1 when the sensitizing dye forms an intramolecular salt;

General formula (II):

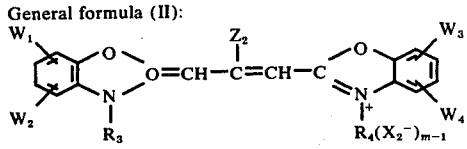

wherein $Z_2$ represents a lower alkyl group (such as methyl group or ethyl group), $W_1$ and $W_2$ each represent a hydrogen atom, a halogen atom (such as chlorine, bromine or fluorine) or an alkyl group (such as methyl group or ethyl group), $W_3$ and $W_4$ each represent a hydrogen atom, a halogen atom (such as chlorine, bromine or fluorine), an alkyl group (such as methyl group or ethyl group), an alkoxy group (such as methoxy group, ethoxy group or propoxy group), a hydroxy group or a phenyl group (such as phenyl group or triol group), where said $W_3$ and $W_4$ may be same or different and may be bonded to each other to form a benzene ring, but at least one of said $W_1$, $W_2$, $W_3$ and $W_4$ is a halogen atom; $R_3$ and $R_4$ each represent a same or different alkyl group (such as methyl group or ethyl group), a sulfoalkyl group (such as 2-sulfoethyl group, 3-sulfopropyl group, 3-sulfobutyl group or 4-sulfobutyl group) or carboxyalkyl group, $X_2^-$ represents acid anions, and $m$ represents an integer of 1 or 2, but $m$ is 1 when the sensitizing dye forms an intramolecular salt.

Thus, joint use of the sensitizing dye of the general formula (I) with that of the general formula (II) in green-sensitive emulsions makes it possible to prevent said emulsions from deterioration of their photographic properties during storage.

The present inventors have further found that the various defects, such as above-mentioned, of the conventional photographic emulsions can be overcome and deterioration of the photographic characteristics during storage can be noticeably retarded by adding certain kinds of sensitizing dyes or coloring matters in suitable combination in addition to the combination of two kinds of sensitizing dyes proposed in Japanese Patent Publication No. 32753/1969. Thus, the object of this invention can be accomplished by adding at least one of the sensitizing dyes expressed by the above general formula (I), at least one of the sensitizing dyes expressed by the above general formula (II) and at least one of the sensitizing dyes expressed by the following general formula (III) in combination to the green-sensitive emulsion of the silver halide photographic sensitive compound:

General formula (III):

-continued

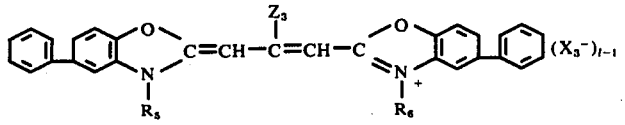

wherein $Z_3$ represents a methyl or ethyl group, $R_5$ and $R_6$ each represent a same or different alkyl group (such as methyl group or ethyl group) or sulfoalkyl group (such as 2-sulfoethyl group, 3-sulfopropyl group, 3-sulfobutyl group or 4-sulfobutyl group), $X_3^-$ represents acid anions, and 1 represents an integer of 1 or 2, but 1 is 1 when the sensitizing dye forms an intramolecular salt.

Listed in the following are the typical examples of the sensitizing dyes used in the photographic emulsion to this invention.

Sensitizing dyes expressed by the general formula (I):

(IA)

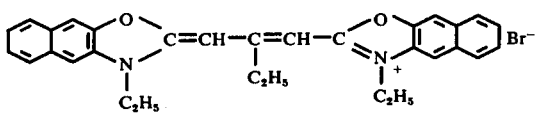

(IB)

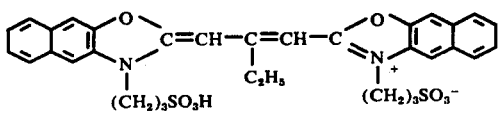

(IC)

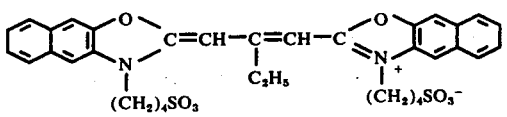

(ID)

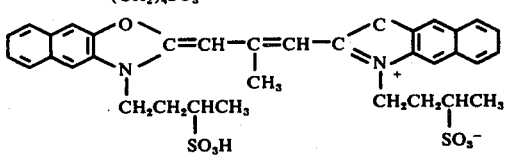

(IE)

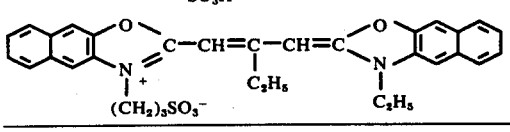

Sensitizing dyes expressed by the general formula (II):

(IIA)

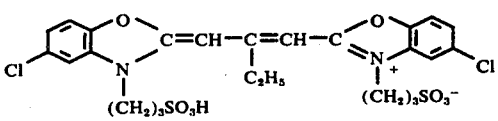

(IIB)

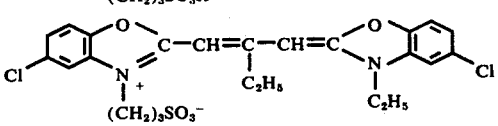

(IIC)

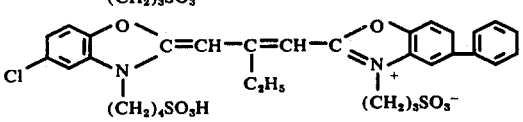

(IID)

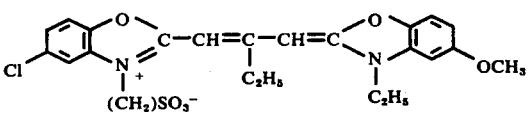

(IIE)

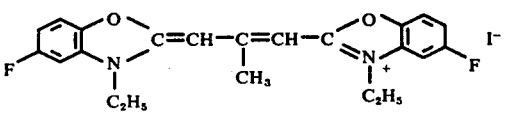

(IIF)

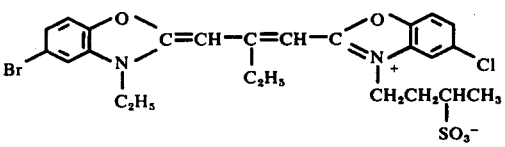

-continued (IIG)

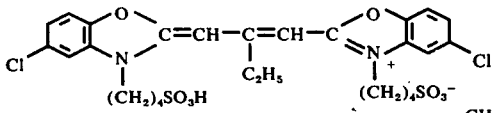

(IIH)

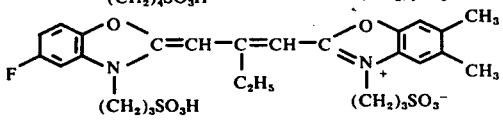

(II I)

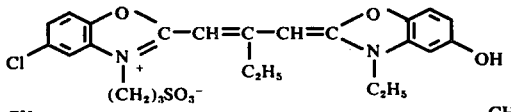

(IIJ)

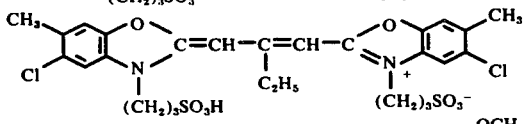

(IIK)

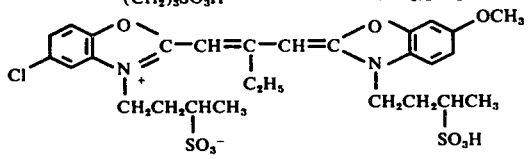

(IIL)

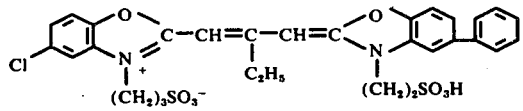

(IIM)

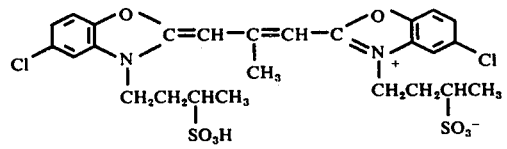

(IIN)

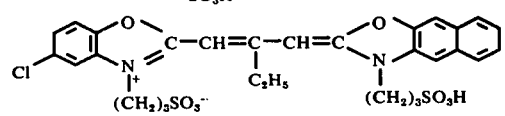

Sensitizing dyes expressed by the general formula (III):

(IIIA)

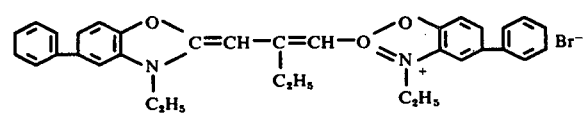

(IIIB)

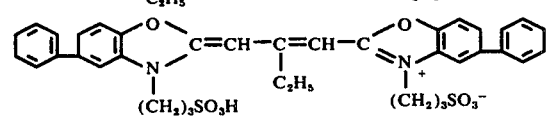

(IIIC)

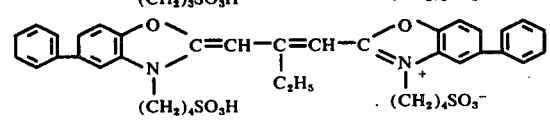

(IIID)

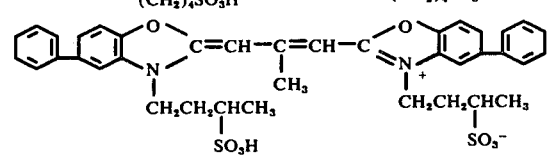

(IIIE)

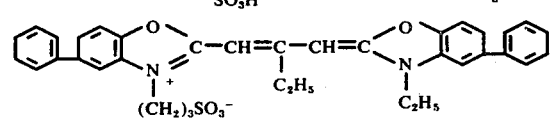

These sensitizing dyes are already known in the art, and they are mentioned in, for instance, Japanese Patent Pub. Nos. 18433/1970, 13821/1968 and 32753/1969; PUPA No. 41733/1973; and British Pat. Nos. 840,233 and 1,297,655. Such dyes can be easily synthesized according to the techniques disclosed in said patents or French Pat. No. 1,108,788.

In case of applying the sensitizing dyes of this invention to a silver halide color photographic emulsion, it is usually desirable to increase sensitivity of the specific spectral wavelength range, and for this purpose, it is desirable to form an aggregate of the pertinent dyes. Therefore, among a plurality of sensitizing dyes expressed by the aforementioned general formulae (I), (II) and (III), use of the easily aggregate ones is most preferred. For this reason, it is recommendable to use the dyes expressed by any of said general formulae where both of $Z_1$ and $Z_2$ represent an ethyl group. Mixing of the sensitizing dyes expressed by any of said general formulae (I), (II) and (III) in a silver halide photographic emulsion may be accomplished by dispersing them directly in the emulsion, or by first dissolving them in a solvent such as water, methanol, ethanol, acetone or methyl cellosolve or a mixed solvent thereof, and then adding such solvent to the emulsion. Said mixing may be also attained by first dissolving the dyes in a solvent (such as phenoxyethanol) which is substantially immiscible with water, then dispersing the mixture in water or hydrophilic colloid, and then adding this dispersoid into the emulsion. In the case of a color emulsion, such sensitizing dyes may be added in admixture with a coupler to the emulsion. Dissolving of these dyes used in combination may be effectuated either by dissolving them separately or in a mixture. Also, addition thereof into the emulsion may be accomplished either in the form of a mixture or by separate addition. The time of addition into the emulsion should preferably coincide with the moment of chemical ripening or thereabout.

The amount of these sensitizing dyes added varies depending on the type of the silver halide photographic emulsion used, but it is usually desirable that the total amount of the combinations of the sensitizing dyes expressed by the general formula (I) and the sensitizing dyes expressed by the general formula (II) will be within the range of 10 to 500 mg, most preferably 100 to 400 mg, per mole of silver halide in the emulsion. The amount ratio (by mole) among the respective combinations of the sensitizing dyes expressed by the general formula (I) and the sensitizing dyes expressed by the general formula (II), respectively, should be generally 1:0.1–8, most preferably 1:0.3–. Further it is usually desirable that the total amount of the combinations of the sensitizing dyes expressed by the general formulae (I), (II) and (III) will be within the range of 10 to 600 mg, most preferably 100 to 400 mg, per mole of silver halide in the emulsion. The amount ratio (by mole) among the respective combinations of sensitizing dyes expressed by the general formulae (I), (II) and (III), respectively, should be generally 1 to 8 : 1 to 8 : 1 to 8, most preferably (2 to 5) : (2 to 5).

The silver halide photographic emulsion according to the present invention includes all types of silver halide photographic emulsions used, for instance, for black and white panchromatic films, panlith and ortholith films, microfilms, facsimile films, gravure films, pan masking films, indirect X-ray photographic films, direct X-ray photographic films, high resolution plate, direct high-speed ortho-films, multiple-tone photographic paper or black and white diffusion transfer materials, as well as all types of silver halide color photographic emulsions such as used for color negative films, color positive films, coupler-in-emulsion-type or Kodachrome-type color reversal films, color aerophotographic films, color X-ray photographic films, color photographic paper, color diffusion transfer materials, or sensitizing materials for silver dye bleach process.

The silver halide photographic emulsion according to the present invention may be used in practical applications by coating one or more kinds of said emulsion in suitable combination with a blue sensitive emulsion, a red sensitive emulsion, an intermediate layer, a filter layer, an antihalation layer, a protective layer and/or the like on the support which has undergone a corona discharging treatment, flame treating, ultraviolet-light irradiation and/or subbing.

The supports which can be used advantageously for the emulsion of this invention include, for instance, baryta paper, resin laminate paper, synthetic paper, metal sheet, glass sheet, cellulose acetate film and cellulose nitrate film, such as for example polyester (such as polyethylene terephthalate) film, polyamide film, polycarbonate film, polystyrene film and the like, and such supports ae suitably selected according to the purpose of use of the silver halide photosensitive material.

The hydrophilic colloids that can be used advantageously for preparing a sensitive emulsion used for producing the silver halide photographic emulsion according to the present invention include, for instance, gelatin, colloidal albumin, agar-agar, gum arabic, alginic acid, cellulose derivatives such as cellulose acetate which has been hydrolyzed to 19 to 26% acetyl content, polyacrylamide, imidated polyacrylamide, zein, vinyl alcohol polymer containing an urethanecarboxylic acid group or cyanoacetyl group such as vinyl alcohol - vinyl cyanoacetate copolymer, polyvinyl alcohol, polyvinyl pyrrolidone, hydrolyzed polyvinyl acetate, and polymers obtained by polymerization of protein or saturated acylated protein and a monomer having a vinyl group.

Silver halide used in the silver halide photographic emulsion according to this invention may be of any type generally used for the silver halide photographic emulsion, such as for example silver bromide, silver chloride, silver iodobromide, silver chlorobromide or silver chloroiodobromide. These silver halide emulsions may be composed of silver halide crystals having (100) face crystal habit or those having (111) face crystal habit, or an admixture thereof. They may be also an emulsion of monodisperse particles or an emulsion of polydisperse particles, or may be a charge emulsion prepared by an ammonia or non-ammonia process or containing a ripening agent such as thioether, selenoether or thiocyanate. PAg may vary over a wide range. These silver halide emulsions can be formed by any known type of method including, for example, a single jet mixing method, a double jet mixing method, a method such as disclosed in Japanese Patent Publication No. 7772/1971 or in U.S. Pat. No. 2,592,250, that is, a so-called conversion method in which there is first formed an emulsion of silver salt particles composed at least partly of silver salt having greater solubility than silver bromide, and then these particles are converted at least partly into silver bromide salt or silver iodobromide salt, or a Lipman's method using fine-granular silver halide having average particle size of less than 0.1. Also, these silver halide emulsions can be sensitized by using a chemical sensitizer, for example, a sulfur sensitizer such as thiosulfate, thiocarbamate, allyl-thiocarbamide, thiourea, allylisothiocyanate or cystine, or an active or inert selenium sensitizer such as dimethylselenourea, selenoacetone, selenourea and potassium selenocyanide, a noble metal sensitizer including a gold compound such as potassium chloroaurate, auric trichloride, potassium auric thiocyanate and 2-aurothiabenzothiazol methyl chloride, a palladium compound such as ammonium chloropalladate and sodium chloropalladite, a platinum compound such as potassium chloroplatinate, a ruthenium compound, a rhodium compound, or an iridium compound. They may be also sensitized reductively by using a reducing agent, or by using a combination of said sensitizers. These emulsions can be stabilized by using a triazole, imidazole, azaindene, benzothiazoline compound, zinc compound, cadmium compound, mercaptan, mercury compound, or noble metal compound such as platinum or palladium compound, or a mixture thereof, and they may contain a thioether type, quaternary ammonium salt type or polyalkylene oxide type sensitizing compound. These emulsions may be also added with a wetting agent, a plasticizer, a physical property improver or the like, such as glycerin, hydroxyalkane such as 1,5-pentanediol, esters of ethylenebisglycolic acid, bisethoxydiethyleneglycol succinate, or water-dispersible particulate high-molecular compound obtained by emulsion polymerization, as well as a film-hardening agent such as an ethyleneimine compound, dioxane derivatives, oxypolysaccharide, dicarboxylic acid chloride, bisester of methanesulfonic acid or vinylsulfonyl type, a coating aid such as saponin or sulfosuccinate, a fluorescent whitener, an antistatic agent, an anti-staining agent, and various other photographic additives.

Concerning the color photographic elements, both blue and red sensitive emulsions used for forming laminations in combination with the green-sensitive silver halide photographic emulsion according to the present invention are optically sensitized by using suitable sensitizing dyes for providing photosensitivity to the respective desired sensitive wave-length ranges. It is possible to use various kinds of sensitizing dyes such as for example cyanine dye, merocyanine dye or composite cyanine dye, and one or more kinds of such sensitizing dyes may be used in combination.

The couplers used in the silver halide photographic emulsion according to this invention may be of the Fischer type or oil-soluble 4- or 2-equivalent couplers, or may be the so-called masking couplers having for example an arylazo group at the active site. Among such couplers, the magenta couplers may be of the 3-acylamino-5-pyrazolone type, 3-anilino-5-pyrazolone type, pyrazolotriazole type, pyrazolino-benzimidazole type, or indazolone type. In the case of false color photographic sensitive emulsions, it is possible to employ the yellow couplers such as benzoylacetoanilide type or pivaloyl-acetoanilide, or cyan couplers such as phenol type or naphthol type. One may also use the so-called DIR couplers (such as disclosed in British Pat. No. 953,454 and U.S. Pat. No. 3,227,554) having introduced to the active site a group forming a compound which induces a development retarding action when it removes from the active site.

For improving the photographic characteristics, the silver halide emulsion according to this invention may be added with a so-called development inhibitor releasing compound, such as for example 2-(1-phenyl-5-tetrazolylthio)-hydroquinone, which releases a development inhibitor in correspondence to the picture density during development. Containment of such development inhibitor releasing compound(s) (shown for example in Japanese PUPA No. 77635/1974, German Pat. No. 2,362,752, and U.S. Pat. Nos. 3,632,345, 3,297,445 and 3,379,529) is particularly desirable in the case of the silver halide color photographic emulsions. Also, a specific coupler such as a so-called competing coupler may be contained in combination with various couplers such as above-mentioned.

The silver halide photographic emulsion according to this invention may contain as an anti-staining agent, a hydroquinone derivative such as for example 2-t-octylhydroquinone, 2,5-di-t-octylhydroquinone or 2-methyl-5-sec-hexadecyl-hydroquinone. Such compounds prove to be useful particularly in the case of a coupler-containing emulsion.

The photographic light-sensitive materials having a layer of the silver halide photographic emulsion according to this invention may be subjected, after exposure, to a normal black and white negative or positive developing treatment or a color negative or coupler-in-emulsion-type or Kodachrome-type reversal developing treatment according to the purpose of use, or may be treated according to a black and white diffusion transfer method or color diffusion transfer method (for example a system using a dye developer or a system described in Japanese PUPA No. 3480/1972). It is also possible to treat said light-sensitive material, after development, according to a stabilization treating method in which said material is treated with a solution mainly composed of ammonium thiocyanate or thiourea. Said material may be also subjected to the combined developing and fixing treatment whereby the material is treated with a solution mainly composed of ammonium thiocyanate or thiourea for allowing simultaneous development and fixing.

The developing agent used for black and white development may be, for example, N-methyl-p-aminophenol sulfate, 1-phenyl-3-pyrazolidone, phenylglycine, ascorbic acid, hydroquinone, methylhydroquinone, chlorohydroquinone, phenylhydroquinone or pyrogallol, which may be used either singly or in combination. For color development, sulfates such as 4-amino-N-diethylaniline, 4-amino-3-methyl-N-diethylaniline, 4-amino-3-methyl-N-ethyl-N-(β-aminosulfoneamidoethyl) aniline, 4-amino-3-methyl-N-ethyl-N-(β-hydroxyethyl)aniline, or 4-amino-3-methyl-N-ethyl-N-(methoxyethyl)aniline. A development accelerator such as benzyl alcohol or N,N'-tetramethyl-p-phenylenediamine may be added as a color developer igredient. It is also possible to blend cobalt complex salt or hydrogen peroxide in the color developer or its after-bath for amplification treatment. Development may be performed in two steps by using the solutions with different base concentrations for better sensitization.

In case of performing a bleaching treatment in color process, it is possible to use a solution containing one or more bleaching agents such as red prussiate, bichromate, aminopolycarboxylic acid iron complex salt, iron chloride and the like. Also, a fixing agent such as sodium thiosulfate, ammonium thiosulfate or thiourea may be contained in the solution. Bleaching and fixing may be carried out separately or simultaneously as a combined bleaching and fixing treatment, and combinations of various known compounds may be used for promoting such bleaching and fixing. Further, in the color process, a stabilizing bath blended with formalin, salts for pH adjustment, an anti-water spotting agent and the like may be used suitably according to the purpose of use of the solution. Any of these treatments can be accomplished at high temperature of more than 30° C and in a very short period of time.

The present invention is now described in further detail by way of some embodiments thereof, but as apparent, the scope of this invention is not limited to these particular embodiments.

EXAMPLE 1

The silver iodobromide emulsions each containing 3 molar % of silver iodide were chemically sensitized, incorporated under agitation at 40° C, with respectively specified amounts of sensitizing dyes, such as shown in Table 1 below, in the form of a methanol solution ($2 \times 10^{-3}$molar concentration) and then allowed to stand under agitation for 10 minutes. Each of the thus treated emulsions was incorporated with suitable amounts of 4-hydroxy-6-methyl-1,3,3a,7-tetrazaindene as fog inhibitor and a film hardening agent and further with a surfactant to prepare a green-sensitive emulsion which was then coated on a cellulose triacetate film support and dried to obtain a specimen.

Two strips were formed from the specimen, and one of which was subjected to preservation treatment (incubation treatment), while the other of which was used as control. Incubation treatment:

Each specimen was kept in a sealed container maintained under an atmosphere of 20% relative humidity and temperature of 55° C. for 7 days.

Subsequently, the specimen which had been subjected to the preservation treatment and the control specimen which had not been subjected to the preservation treatment were subjected to green light exposure by using an intensity scale sensitometer (KS-IB type sensitometer manufactured by Konishiroku Photo Industry Co., Ltd.), followed by treatment at 20 C. for 6 minutes by use of a JIS-B developer, and then stopping, fixing and drying. Thereafter, relative speed and fog of each specimen thus treated were measured to obtain the results as shown in Table 1 below.

Table 1

| Specimen No. | Sensitizing dye | Amount added (ml/mole Ag) | Sensitizing dye | Amount added (ml/mole Ag) | Control | | Preservation treatment (RH 20%, 55° C, 7 days) | |
|---|---|---|---|---|---|---|---|---|
| | | | | | Relative speed | Fog | Relative speed | Fog |
| 1 | IB | 150 | — | — | 100 | 0.04 | — | — |
| 2 | IB | 50 | IIB | 100 | 125 | 0.04 | 112 | 0.06 |
| 3 | — | — | IIB | 150 | 88 | 0.03 | — | — |
| 4 | IC | 150 | — | — | 105 | 0.03 | — | — |
| 5 | IC | 50 | IIG | 100 | 132 | 0.03 | 125 | 0.04 |
| 6 | — | — | IIG | 150 | 90 | 0.04 | — | — |
| 7 | IA | 150 | — | — | 98 | 0.04 | — | — |
| 8 | IA | 50 | IIA | 100 | 129 | 0.03 | 116 | 0.05 |
| 9 | — | — | IIA | 150 | 101 | 0.03 | — | — |

As is clear from Table 1, it is understood that the specimens prepared according to the present invention (specimens Nos. 2, 5 and 8), as compared with the control specimens, were excellent in supersensitizing effect and remained stable in speed and fog even after having been subjected to the preservation treatment.

EXAMPLE 2

The silver iodobromide emulsions each containing 6 molar% of silver iodide were chemically sensitized with a sulfur compound and a gold compound, and then sensitizing dyes such as listed in Table 2 below were added, each in the form of a methanol solution ($2 \times 10^{-3}$ molar concentration), to the respective emulsions. Then further added thereto were 4-hydroxy-6-methyl-1,3,3a,7-tetrazaindene as stabilizer and a dispersion prepared by dispersing a solution of 1-(2,4,6-trichlorophenyl)-3-{3-[α-(2,4-di-t-amylphenoxy)-acetamide]-benzamide} -5-pyrazolone as coupler in tri-o-cresylphosphate into an aqueous gelatin solution, as well as a film-hardening agent, saponin as coating aid and a pH adjuster, thereby preparing the green sensitive emulsions. These emulsions were then applied respectively to a cellulose triacetate film support and dried to obtain specimens.

These specimens were subjected to a preservation treatment same as practiced in Example 1, green-light exposure by using an intensity scale sensitometer, and then first development, stopping, color development, bleaching and fixing according to the following treating steps and prescriptions.

| Treating steps | Treating time | | Treating temp. |
|---|---|---|---|
| First development | 3 min. | | 38° C |
| First Stopping | | 30 sec. | 38° C |
| Water washing | 1 min. | | 38° C |
| Color development | 3 min. | 40 sec. | 43° C |
| Second stopping | | 30 sec. | 38° C |
| Water washing | 1 min. | | " |
| Bleaching | 6 min. | | " |
| Fixing | 6 min. | | " |
| Water washing | 3 min. | | " |
| Stabilization | | 30 sec. | " |

| First developing solution | | |
|---|---|---|
| Sodium polyphosphate | 2.0 | g |
| Sodium bisulfite (anhydrous) | 8.0 | g |
| Phenidone | 0.35 | g |
| Sodium sulfite | 37.0 | g |
| Hydroquinone | 5.5 | g |
| Sodium carbonate | 33.0 | g |
| Sodium thiocyanate (10% aqueous solution) | 13.8 | ml |
| Sodium bromide | 1.3 | g |
| Potassium iodide (0.1% aqueous solution) | 23.0 | ml |

The above-mentioned substances were mixed and charged with water to obtain one-liter developing solution with pH adjusted to 9.9 ± 1.

| First stopping solution | | |
|---|---|---|
| Sodium hydroxide | 1.75 | g |
| Glacial acetic acid | 30.0 | ml |

These substances were mixed and charged with water to obtain one-liter stopping solution with pH adjusted to 3.8.

| Color developing solution | | |
|---|---|---|
| Sodium polyphosphate | 5.0 | g |

-continued

| Color developing solution | | |
|---|---|---|
| Benzyl alcohol | 4.5 | g |
| Sodium sulfite | 7.5 | g |
| Sodium tertiary phosphate 12 hydrous salt | 36.0 | g |
| Sodium bromide | 0.9 | g |
| Potassium iodide (0.1% aqueous solution) | 90.0 | ml |
| Sodium hydroxide (added in a suitable amount as pH adjuster) | | |
| 4-Amino-N-ethyl-N-(β-methanesulfonamidoethyl)-m-toluidinesesquisulfate monohydrate | 11.0 | g |
| Ethyleneamine | 3.0 | g |
| t-Butylaminoboranhydrande | 0.07 | g |

The mixture of these substances was charged with water to obtain one-liter color developing solution with pH adjusted to 11.65 ± 0.1.

| Bleaching solution | | |
|---|---|---|
| Ethylenediaminetetraacetic acid (EDTA) ferric ammonium salt | 170 | g |
| Ammonium bromide | 300 | g |

They are mixed and charged with water to prepare one-liter bleaching solution with pH adjusted to 5.8 to 6.0.

| Fixing solution | | |
|---|---|---|
| Sodium thiosulfate (anhydrous) | 94.5 | g |
| Sodium bisulfite (anhydrous) | 17.6 | g |
| Sodium secondary phosphate (anhydrous) | 15.0 | g |

These substances were mixed and charged with water to prepare one-liter fixing solution with pH adjusted to 5.9 ± 0.2.

Magenta color density of each of the specimens thus treated was measured to draw a comparison of relative speed and maximum density of these specimens. The results obtained were as shown in Table 2 below.

Table 2

| Specimen No. | Sensitizing dye | Amount added (ml/mole Ag) | Sensitizing dye | Amount added (ml/mole Ag) | Control Relative speed | Control Dmax. | Preservation treatment (RH 20%, 55° C 7 days) Relative speed | Preservation treatment Dmax. |
|---|---|---|---|---|---|---|---|---|
| 10 | IA | 160 | — | — | 100 | 2.95 | — | — |
| 11 | IA | 80 | IIJ | 80 | 121 | 3.05 | 112 | 3.00 |
| 12 | — | — | IIJ | 160 | 105 | 3.06 | — | — |
| 13 | IB | 160 | — | — | 104 | 3.17 | — | — |
| 14 | IB | 80 | IIC | 80 | 135 | 3.24 | 129 | 3.20 |
| 15 | — | — | IIC | 160 | 100 | 3.21 | — | — |
| 16 | IE | 160 | — | — | 98 | 2.96 | — | — |
| 17 | IE | 80 | IIK | 80 | 129 | 3.16 | 121 | 3.11 |
| 18 | — | — | IIK | 160 | 106 | 3.18 | — | — |

As is clear from Table 2, it is understood that the specimens prepared according to the present invention (specimens Nos. 11, 14 and 17), as compared with the control specimens, were excellent in supersensitizing effect and, at the same time, high in D max, suffer little fogging and practically showed no drop in speed, even after having been subjected to the preservation treatment.

EXAMPLE 3

The high speed silver iodobromide neutral emulsions each containing 5 molar% of silver iodide and chemically sensitized by a sulfur compound and a gold compound were prepared, and these emulsions were incorporated with respectively specified amounts of sensitizing dyes, such as shown in Table 3 below, in the form of a methanol solution ($2 \times 10^{-3}$ molar concentration) under agitation at 40° C. Each of the thus treated emulsions was further incorporated with 4-hydroxy-6-methyl-1,3,3a,7-tetrazaindnene as fog inhibitor, a dispersion of 1-(2,4,6-trichlorophenyl)-3-{3-α-(2,4-di-t-amylphenoxy)-acetamide}-5-pyrazolone and 1-(2,4,6-trichlorophenyl)-3-{3-α-(2,4-di-t-amylphenoxy)-acetamide}4-(4-methoxyphenylazo)-5-pyrazolone as magenta coupler in tri-o-cresyl phosphate, suitable amounts of a surfactant and a film-hardening agent to prepare a green sensitive emulsion. The emulsions thus prepared were individually coated on a cellulose triacetate film support and dried to obtain specimens.

Each of the specimens thus obtained was subjected to preservation treatment same as practiced in Example 1, and after green-light exposure by use of a intensity scale sensitometer, color development was carried out according to the following treating steps and prescriptions.

| Treating steps (at 38° C) | Treating time |
|---|---|
| Color development | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilization | 1 min. 30 sec. |

| Composition of color development solution | | |
|---|---|---|
| 4-Amino-3-methyl-N-ethyl-N-(β-hydroxyethyl)-aniline sulfate | 4.8 | g |
| Anhydrous sodium sulfite | 0.14 | g |
| Hydroxyamine 1/2 sulfate | 1.98 | g |
| Sulfuric acid | 0.74 | ml |
| Anhydrous potassium carbonate | 28.85 | g |
| Anhydrous potassium bicarbonate | 3.46 | g |
| Anhydrous potassium sulfate | 5.10 | g |
| Potassium bromide | 1.16 | g |
| Sodium chloride | 0.14 | g |
| Nitrilotriacetic acid tertiary sodium salt (1 hydrous salt) | 1.20 | g |
| Potassium hydroxide | 1.48 | g |

The above-mentioned substances were mixed and charged with water to prepare one-liter solution.

| Composition of bleaching solution | | |
|---|---|---|
| Ethylenediaminetetraacetic acid iron ammonium salt | 100.0 | g |
| Ethylenediaminetetraacetic acid secondary ammonium salt | 10.0 | g |
| Ammonium bromide | 150.0 | g |
| Glacial acetic acid | 10.0 | ml |

The mixture of the above-mentioned substances was charged with water to obtain one-liter bleaching solution, and pH of the solution was adjusted to 6.0 by using ammonia water.

| Composition of fixing solution | | |
|---|---|---|
| Ammonium thiosulfate | 175.0 | g |
| Anhydrous sodium sulfite | 8.6 | g |
| Sodium metasulfite | 2.3 | g |

These substances were mixed and charged with water to prepare one-liter solution with pH being adjusted to 6.0 by using acetic acid.

| Composition of stabilizing solution | | |
|---|---|---|
| Formalin (37% aqueous solution) | 1.5 | ml |
| Konidax (produced by Konishiroku Photo Industry Co., Ltd.) | 7.5 | ml |

The mixture of the above-mentioned substances was charged with water to prepare one-liter stabilizing solution.

Magenta color developing density was measured for each of the specimens which had undergone the color developing treatment, thereby to draw a comparison of relative speed and fog of these specimens. The results obtained were as shown in Table 3 below.

Table 3

| Specimen No. | Sensitizing dye | Amount added (ml/mole Ag) | Sensitizing dye | Amount added (ml/mole Ag) | Control Relative speed | Control Fog | Preservation treatment (RH 20%, 55° C 7 days) Relative speed | Preservation treatment Fog |
|---|---|---|---|---|---|---|---|---|
| 19 | — | — | IIA | 220 | 87 | 0.12 | — | — |
| 20 | IB | 75 ($2 \times 10^{-3}$) | IIA | 145 | 132 | 0.11 | 130 | 0.13 |
| 21 | IB | 220 | — | — | 100 | 0.10 | — | — |
| 22 | IB | 75 | IID | 145 | 129 | 0.10 | 125 | 0.12 |
| 23 | — | — | IID | 220 | 95 | 0.13 | — | — |
| 24 | IC | 220 | — | — | 96 | 0.10 | — | — |
| 25 | IC | 75 | IIG | 145 | 130 | 0.11 | 125 | 0.14 |
| 26 | — | — | IIG | 220 | 90 | 0.13 | — | — |

As is clear from Table 3, it is understood that the specimens (specimens Nos. 20, 22 and 25), as compared with the control specimens, were excellent in supersensitizing effect and, at the same time, were less in formation of increased fogs and practically showed no drop in speed, even after having been subjected to the preservation treatment.

EXAMPLE 4

The silver iodobromide emulsions each containing 3 molar% of silver iodide were chemically sensitized with a sulfur compound and a gold compound, then sensitizing dyes such as named in Table 4 below were added in the designated amounts, each in the form of a methanol solution ($2 \times 10^{-3}$ molar concentration), and then 4-hydroxy-6-methyl-1,3,3a7-tetrazine was added as stabilizer to each solution, thereby preparing the silver halide photographic emulsions. Each of these emulsions was applied on a cellulose acetate film support and dried to obtain specimens.

Two strips were formed from each of these specimens, and one of such strips was subjected to a preservation treatment (incubation treatment) while treating the other strip as control.

Incubation treatment:

Each specimen was kept in a sealed container maintained under an atmosphere of 20% relative humidity (RH) and 55° C temperature for 7 days.

Then the specimens which have undergone the said preservation treatment and the control specimens were subjected to green-light exposure by using an intensity scale sensitometer (KS-1B Sensitometer mfd. by Konishiroku Shashin Kogyo Co., Ltd.), followed by a developing treatment at 20° C for 6 minutes by using the JIS-B developing solution, and then stopping, fixing and drying, and the relative sensitivity and fogging of each of the thus treated specimens were measured. The results are shown in Table 4 below.

Table 4

| Specimen No. | Sensitizing dyes used and amount ml (molar concentration $2 \times 10^{-3}$)/mole Ag | Control Relative sensitivity | Control Fogging | Preservation treatment (RH 20%, 55° C, 7 days) Relative sensitivity | Preservation treatment Fogging |
|---|---|---|---|---|---|
| 27 | IC[50] + IIC[150] | 100 | 0.09 | 63 | 0.18 |
| 28 | IC[50] + IID[75] + IIIC[75] | 125 | 0.09 | 115 | 0.13 |
| 29 | IB[50] + IIA[150] | 98 | 0.07 | 70 | 0.15 |
| 30 | IB[50] + IIJ[75] + IIIA[75] | 120 | 0.07 | 115 | 0.11 |
| 31 | IA[50] + IIA[150] | 90 | 0.06 | 65 | 0.15 |
| 32 | IA[50] + IIC[75] + IIIA[75] | 116 | 0.07 | 100 | 0.11 |
| 33 | IC[50] + IB[75] + IIE[75] | 98 | 0.08 | 65 | 0.16 |
| 34 | IC[50] + IB[75] + IIC[35] + IIE[40] | 121 | 0.08 | 115 | 0.12 |

As apparent from Table 4, the specimens prepared according to the present invention (Specimen Nos. 28, 30, 32 and 34), as compared with the controls (Specimen Nos. 27, 29, 31 and 33), are elevated in photosensitivity and also remain stable in sensitivity and fogging even after the preservation treatment.

EXAMPLE 5

The silver iodobromide emulsions each containing 6 molar% of silver iodide were chemically sensitized with a sulfur compound and a gold compound, and then sensitizing dyes such as listed in Table 5 below were added, each in the form of a methanol solution ($2 \times 10^{-3}$ molar concentration), to the respective emulsions. Then further added thereto were 4-hydroxy-6-methyl-1,3,3a,7-tetrazinedene as stabilizer and a dispersion prepared by dispersing a solution of 1-(2,4,6-trichlorophenyl)-3--{3-[α-(2,4-di-t-amylphenoxy)-acetoamide]benzamide}-5-pyrazolone as coupler in tri-o-cresylphosphate in an aqueous gelatin solution, as well as a film-hardening agent, an application assistant (saponin) and a pH adjuster, thereby preparing the green sensitive emulsions. These emulsions were then applied respectively to a cellulose triacetate film substrate and dried to obtain specimens.

These specimens were subjected to a preservation treatment same as practiced in Example 1, green-light exposure by using an intensity scale sensitometer, and then first development, stopping, color development, bleaching and fixing according to the following treating steps and prescriptions.

| Treating steps | Treating time | Treating temp. |
|---|---|---|
| First development | 3 min. | 38° C |
| First Stopping | 30 sec. | 38° C |
| Water washing | 1 min. | 38° C |
| Color development | 3 min. 40 sec. | 43° C |
| Second stopping | 30 sec. | 38° C |
| Water washing | 1 min. | 38° C |
| Bleaching | 6 min. | 38° C |
| Fixing | 6 min. | 38° C |
| Water washing | 3 min. | 38° C |
| Stabilization | 30 sec. | 38° C |

| First Developing solution | | |
|---|---|---|
| Sodium polyphosphate | 2.0 | g |
| Sodium bisulfite (anhydrous) | 8.0 | g |
| Phenidone | 0.35 | g |
| Sodium sulfite | 37.0 | g |
| Hydroquinone | 5.5 | g |
| Sodium carbonate | 33.0 | g |
| Sodium thiocyanate (10% aqueous solution) | 13.8 | ml |
| Sodium bromide | 1.3 | g |
| Potassium iodide (0.1% aqueous solution) | 23.0 | ml |

The above-said substances were mixed and added with water to obtain one-liter developing solution with pH adjusted to 9.9 ± 1.

| First stopping solution | | |
|---|---|---|
| Sodium hydroxide | 1.75 | g |
| Glacial acetic acid | 30.0 | ml |

These substances were mixed and added with water to obtain one-liter stopping solution with pH adjusted to 3.8.

| Color developing solution | | |
|---|---|---|
| Sodium polyphosphate | 5.0 | g |
| Benzyl alcohol | 4.5 | g |
| Sodium sulfite | 7.5 | g |
| Sodium tertiary phosphate 12 hydrous salt | 36.0 | g |
| Sodium bromide | 0.9 | g |
| Potassium iodide (0.1% aqueous solution) | 90.0 | ml |
| Sodium hydroxide (added in a suitable amount as pH adjuster) | | |
| 4-Amino-N-ethyl-N-(β-methanesulfonamidoethyl)-m-toluidinesesquisulfate monohydrate | 11.0 | g |
| Ethylenamine | 3.0 | g |
| t-butylaminoboranhydrande | 0.07 | g |

The mixture of these substances was added with water to obtain one-litre solution with pH adjusted to 11.65 ± 0.1.

| Bleaching solution | | |
|---|---|---|
| Ethylenediaminetetraacetic acid (EDTA) ferric ammonium salt | 170 | g |
| Ammonium bromide | 300 | g |

They were mixed and added with water to prepare one-liter bleaching soluton with pH adjusted to 5.8 to 6.0.

| Fixing solution | | |
|---|---|---|
| Sodium thiosulfate (anhydrous) | 94.5 | g |
| Sodium bisulfite (anhydrous) | 17.6 | g |
| Sodium secondary phosphate (anhydrous) | 15.0 | g |

These substances were mixed and added with water to prepare one-liter fixing solution with pH adjusted to 5.9 ± 0.2.

The magenta color density of each of the thus obtained specimens was measured (measuring wavelength 547 nm), and the maximum density (Dmax) and the degree of decrease of sensitivity of the specimens which had undergone the preservation treatment were examined in comparison with the controls. The results are shown in Table 5 below.

Table 5

| Specimen No. | Sensitizing dyes used and amount ml (molar concentration $2 \times 10^{-3}$)/mole Ag | Control | | Preservation treatment (RH20%, 55° C, 7 days) | |
|---|---|---|---|---|---|
| | | Relative sensitivity | Dmax | Relative sensitivity | Dmax |
| 35 | IA [75 + IIIE[125] | 100 | 3.08 | 71 | 2.84 |
| 36 | IA [75] + IID[90] + IIIE[90] | 126 | 3.10 | 113 | 3.03 |
| 37 | IC [75] + IIIC[125] | 95 | 2.95 | 68 | 2.77 |
| 38 | IC [75] + IIG[90] + IIIC[90] | 120 | 3.06 | 110 | 3.00 |
| 39 | IB [75] + IIIB[125] | 103 | 3.04 | 75 | 2.78 |
| 40 | IB [75] + IIN[90] + IIIB[90] | 135 | 3.12 | 125 | 3.05 |
| 41 | IC [75] + IIIC[75] + IIIE[50] | 107 | 3.07 | 81 | 2.90 |
| 42 | IC [75] + IIF[90] + IIIC[55]+ IIIE[35] | 130 | 3.19 | 121 | 3.12 |

As apparent from Table 5, the specimens prepared according to the present invention (Specimen Nos. 36, 38, 40 and 42) are better in sensitizing effect than the controls (Specimen Nos. 35, 37, 39 and 41), and are also high in Dmax and suffer little fogging and almost no drop of sensitivity even if subjected to a preservation treatment.

EXAMPLE 6

The neutral process high sensitivity silver iodobromide emulsions each containing 5 molar% of silver iodide and chemically sensitized by a sulfur compound and a gold compound were prepared, and these emulsions were added with respectively specified amounts of sensitizing dyes, such as shown in Table 6 below, in the form of a methanol solution ($2 \times 10^{-3}$ molar concentration) under agitation at 40° C. Each of the thus treated emulsions was further added with 4-hydroxy-6-methyl-1,3,3a,7-tetrazinedene as fog inhibitor, a dispersion of 1-(2,4,6-trichlorophenyl)-3-{3-[α-(2,4-di-t-amylphenoxy)-acetoamide]benzamide}-5-pyrazolone as magenta coupler in tri-o-cresyl-phosphate, suitable amounts of surfactant and film-hardening agent to produce green sensitive emulsions, and these emulsions were coated on the respective cellulose triacetate film support and dried to obtain the specimens (Specimen Nos. 43, 44, 45, 46 and 47).

Each of these specimens was subjected to a preservation treatment same as practiced in Example 4, and then after performing green-light exposure by using an intensity scale sensitometer, color development was carried out according to the following treating steps and prescriptions.

| Treating steps (at 38° C) | Treating time |
|---|---|
| Color development | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilization | 1 min. 30 sec. |

| Composition of color developing solution | | |
|---|---|---|
| 4-Amino-3-methyl-N-ethyl-N-(β-hydroxyethyl)-aniline sulfate | 4.8 | g |
| Anhydrous sodium sulfite | 0.14 | g |
| Hydroxylamine ½sulfate | 1.98 | g |
| Sulfuric acid | 0.74 | mg |
| Anhydrous potassium carbonate | 28.85 | g |
| Anhydrous potassium bicarbonate | 3.46 | g |
| Anhydrous potassium sulfite | 5.10 | g |
| Potassium bromide | 1.16 | g |
| Sodium chloride | 0.14 | g |
| Nitrilotriacetic acid tertiary sodium salt (1 hydrous salt) | 1.20 | g |
| Potassium hydroxide | 1.48 | g |

The above named substances were mixed and added with water to prepare one-liter solution.

| Composition of bleaching solution | | |
|---|---|---|
| Ethylenediaminetetraacetic acid iron ammonium salt | 100.0 | g |
| Ethylenediaminetetraacetic acid secondary ammonium salt | 10.0 | g |
| Ammonium bromide | 150.0 | ml |
| Glacial acetic acid | 10.0 | ml |

The mixture of the above-said substances was added with water to obtain one-liter bleaching solution, and pH of the solution was adjusted to 6.0 by using ammonia water.

| Composition of fixing solution | | |
|---|---|---|
| Ammonium thiosulfate | 175.0 | g |
| Anhydrous sodium sulfite | 8.6 | g |
| Sodium metabisulfite | 2.3 | g |

These substances were mixed and added with water to prepare one-liter solution with pH being adjusted to 6.0 by using acetic acid.

| Composition of stabilizing solution | | |
|---|---|---|
| Formalin (37% aqueous solution) | 1.5 | ml |
| Konidax (produced by Konishiroku Photo Industry Co., Ltd.) | 7.5 | ml |

A mixture of said substances was added with water to prepare one-liter stabilizing solution.

The magenta color density was measured (measuring wavelength 547 nm) for each of the specimens which had undergone the color developing treatment, and the degrees of increase of fogging and decrease of sensitivity of the preservation-treated specimens were examined in comparison with the controls. The results are shown in table 6 below.

Table 6

| Specimen No. | Sensitizing dyes used and amount ml (molar concentration $2 \times 10^{-3}$)/mole Ag | Control | | Preservation treatment (RH20%, 55° C, 7 days) | |
|---|---|---|---|---|---|
| | | Relative sensitivity | Fogging | Relative sensitivity | Fogging |
| 43 | IC [75] + IIIB[125] | 100 | 0.17 | 71 | 0.23 |
| 44 | IC [75] + IIA[100 + IIIB[85] | 125 | 0.18 | 119 | 0.20 |
| 45 | IB [75] + IIA[50] + IIG[50] + IIB[85] | 120 | 0.18 | 112 | 0.20 |
| 46 | IB [75 ] + IIG[100] + IIIE[85] | 110 | 0.17 | 100 | 0.19 |
| 47 | IB [75] + IIIE[125] | 95 | 0.18 | 68 | 0.25 |

It is noted from Table 6 that the specimens according to the present invention (Specimen Nos. 44, 45 and 46), as compared with the controls (Specimen Nos. 43 and 47), are higher in sensitivity and also suffer little decrease of sensitivity and little increase of fogging after the preservation treatment.

EXAMPLE 7

The high sensitivity silver iodobromide emulsions containing 5 molar% of silver iodide and chemically sensitized with sodium thiosulfate and chloroauric acid were added respectively with sensitizing dyes, such as shown in Table 7 below, in the form of a methanol solution ($2 \times 10^{-3}$ molar concentration) under agitation for 10 minutes. Each of the thus treated emulsions was further added with 4-hydroxy-6-methyl-1,3,3a,7-tetrazinedene and 1-phenyl-5-mercaptotetrazole as fog inhibitor, a dispersion of 1-(2,4,6-trichlorophenyl)-3-

{3-[α-(2,4-di-t-amylphenoxy)-acetoamide]-benzamide}-5-pyrazolone and 1-(2,4,6-trichlorophenyl)-3-(2-chloro-5-octadecenyl(Δ1-2)succinimide)-anilino-4-(α-naphthyl-azo)-5-pyrazolone as magenta coupler and 2-(1' -phenyl-5'-tetrazolylthio)-4-octadecylsuccinimide-indane-1-on as development inhibitor releasing compound in tri-o-cresylphosphate, as well as suitable amounts of a surfactant and a film-hardening agent to thereby obtain the green sensitive emulsion, and these emulsions were applied on the respective cellulose triacetate film support and dried to prepare the specimens (Specimen Nos. 48, 49, 50 and 51).

Each of these specimens was subjected to a preservation treatment same as employed in Example 4, and then after performing green-light exposure by using an intensity scale sensitometer, color development was carried out according to the treating steps and prescriptions same as specified in Example 6.

The magenta color developing density was measured (measuring wavelength 547 nm) for each of the specimens which had undergone the color developing treatment, and the degrees of increase of fogging and decrease of sensitivity of the treated specimens were examined in comparison with the non-treated control specimens. The results are shown in Table 7 below.

(Δ 1-2)succinimide)-anilino-4-(α-naphthylazo)-5-pyrazolone as magenta coupler, and 1.5 gr of 2-bromo-2-(1'-phenyl-5'-tetrazolylthio)-4-octadecylsuccinimide-indane-1-on as development inhibitor releasing compound in tri-o-cresylphosphate and dispersing this mixture in a gelatin aqueous solution, and also containing 1.0 gr of 4-hydroxy-6-methyl-1,3,3a,7-tetrazinedene and 0.05 gr of 1-phenyl-5-mercaptotetrazole as fog inhibitor, and this emulsion was applied on the support so that the ratio of gelatin to silver will be 2.9 to 1.4 (g/m²) and that the dry film thickness will be 4.0 μ. This emulsion was a silver iodobromide emulsion containing 8 molar% of silver iodide with particle size of 0.8 to 0.5μ.

Layer 6 . . . magenta-forming green sensitive highsensitivity silver halide emulsion layer.

There was prepared a silver iodobromide gelatin emulsion containing 0.07 gr of the compound (IB) and 0.1 gr of the compound (IIIB) per 1 mole of silver halide, and also containing a dispersion prepared by dissolving a mixture consisting of 10 gr of 1-(2,4,6-trichlorophenyl)-3-{3-[α-(2,4-di-t-amylphenoxy)-acetoamide]-benzamide}-5-pyrazolone and 3.0 gr of 1-(2,4,6-trichlorophenyl)-3-{3-[α-(2,4-di-t-amylphenoxy)-acetoamide]-benzamide}-4-(4-methoxyphenylazo)-5-pyrazolone as magenta coupler and 1.5 gr of 2,5-di-t-octyl-hydroquinone as anti-staining agent in tri-o-cresylphosphate and dispersing this mixture in an aqueous solution of gelatin, and further containing 1.0 gr of 4-hydroxy-6-methyl-1,3,3a,7-tetrazinedene and 0.01 gr of 1-phenyl-5-mercaptotetrazole as fog inhibitor, and this emulsion was applied on the substrate such that the ratio of gelatin to silver will be 2.5 to 1.7 (g/m²) and that the dry film thickness will be 3.0 μ. This emulsion is a silver iodobromide emulsion containing 7 molar% of silver iodie with particle size of 1.5 to 0.7

Table 7

| Specimen No. | Sensitizing dyes used and amount ml (molar concentration $2 \times 10^{-3}$)/mole Ag | Control | | Preservation treatment (RH 20%, 55° C, 7 days) | |
|---|---|---|---|---|---|
| | | Relative sensitivity | Fogging | Relative sensitivity | Fogging |
| 48 | IE[75] + IIIC[125] | 98 | 0.12 | 65 | 0.16 |
| 49 | IE[75] + IID[100] + IIIC[85] | 115 | 0.12 | 105 | 0.14 |
| 50 | IB[75] + IIIB[125] | 103 | 0.13 | 70 | 0.17 |
| 51 | IB[75] + IIA[100] + IIIB[85] | 126 | 0.12 | 120 | 0.14 |

As apparent from Table 7, the specimens treated according to the present invention (Specimen Nos. 47 and 51) are high in sensitivity and also suffer little decrease of sensitivity and little increase of fogging after preservation, as compared with the controls (Specimen Nos. 48 and 50).

EXAMPLE 8

The hereinbelow described layers were coated in the order of number on a cellulose acetate film 10 support to prepare the specimen 52.

Layer 1 . . . anti-halation layer

Layer 2 . . . intermediate gelatin layer

Layer 3 . . . red sensitive silver halide gelatin emulsion layer sensitized by a red sensitizing dye containing a cyan coupler Layer 4 . . . intermediate gelatin layer Layer 5 . . . magenta-forming green sensitive low-sensitivity silver halide gelatin emulsion layer.

There was prepared a silver iodobromide gelatin emulsion containing 0.09 gr of the compound (IB) (see Table 8) and 0.15 gr of the compound (IIIB) per 1 mole of silver halide, and also containing a dispersion prepared by dissolving a mixture consisting of 40 gr of 1-(2,4,6-trichlorophenyl)-3-{3-[α-(2,4-di-t-amylphenoxy)-acetoamide]-benzamide}-5-pyrazolone, 7.0 gr of 1-(2,4,6-trichlorophenyl)-3-(3-dodecylsuccinimidebenzamide)-5-oxo-2-pyrazoline, and 10 gr of 1-(2,4,6-trichlorophenyl)-3-(2-chloro-5-octadecenyl Layer 7 . . . intermediate gelatin layer Layer 8 . . . filter layer containing yellow colloidal silver Layer 9 . . . blue sensitive silver halide gelatin emulsion layer containing a yellow coupler Layer 10 . . . gelatin protective layer.

Beside the above-said specimen (Specimen No. 52), there were also prepared five additional specimens (Specimen Nos. 53, 54, 55, 56 and 57) which were same in structural composition as the said specimen (No. 52) except that the different sensitizing dyes, such as shown in Table 8, were used for Layer 5 and Layer 6.

These specimens were subjected to a preservation treatment same as practiced in Example 4, and then after performing exposure with 160-lux daylight color (5500° K) by using an intensity scale sensitometer, a color developing treatment was conducted after the manner of Example 6.

Then green density was measured by a computer densitometer made by Konishiroku Photo Industry Co., Ltd. for each of the specimens which had undergone the color developing treatment, and the degrees of increase of fogging and drop of sensitivity of each of the specimens which had undergone the preservation treatment were examined in comparison with the non-treated controls. The results are shown in Table 8 below.

Table 8

| Specimen No. | Sensitizing dyes used and loads thereof (g/ Ag mole) layer-5 | layer-6 | Control Relative sensitivity | Fogging | Preservation treatment(RH 20%, 55° C,7 days Relative sensitivity | Fogging |
|---|---|---|---|---|---|---|
| 52 | IB[0.09] + IIIB[0.15] | IB[0.07] + IIIB[0.10] | 100 | 0.12 | 81 | 0.15 |
| 53 | IB[0.09] + IIA[0.10] + IIIB[0.10] | IB[0.07] + IIA[0.08] + IIIB[0.08] | 118 | 0.11 | 115 | 0.13 |
| 54 | IC[0.09] + IIIC[0.15] | IC[0.07] + IIIC[0.10] | 105 | 0.13 | 78 | 0.17 |
| 55 | IC[0.09] + IIIC[0.10] + IIIG[0.10] | IC[0.07] + IIG[0.08] + IIIC[0.08] | 120 | 0.13 | 112 | 0.15 |
| 56 | IE[0.09] + IIIE[0.15] | IE[0.07] + IIE[0.15] | 98 | 0.11 | 71 | 0.16 |
| 57 | IE[0.09] + III[0.10] + IIIE[0.10] | IE[0.07] + II I[0.10] + IIIC[0.10] | 125 | 0.11 | 119 | 0.13 |

As apparent from Table 8, the specimens according to the present invention (Specimen Nos. 53, 55 and 57), as compared with the controls (Specimen Nos. 52, 54 and 56), showed little drop of sensitivity and little increase of fogging after the preservation treatment.

What we claim is:

1. A silver halide photographic emulsion containing in combination at least one of the sensitizing dyes expressed by the following general formula (I) and at least one of the sensitizing dyes expressed by the following general formula (II):

General formula (I):

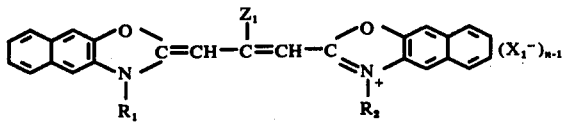

wherein $Z_1$ represents a methyl or ethyl group, $R_1$ and $R_2$ each represent an alkyl or sulfoalkyl group, $X_1^-$represents acid anions, and n represents an integer of 1 or 2, but n is 1 when the sensitizing dye forms an intramolecular salt;

General formula (II):

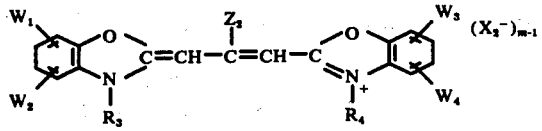

wherein $Z_2$ represents a lower alkyl group, $W_1$ and $W_2$ each represent a hydrogen or halogen atom or an alkyl group, $W_3$ and $W_4$ each represent a hydrogen or halogen atom or an alkyl, alkoxy, hydroxy or phenyl group, where $W_3$ and $W_4$ may be joined to form a benzene ring, but at least one of said $W_1$, $W_2$, $W_3$ and $W_4$ is a halogen atom, $R_3$ and $R_4$ each represent an alkyl, sulfoalkyl or carboxyalkyl group, $X_2^-$ represents acid anions, and *m* represents an integer of 1 or 2, but *m* is 1 when the sensitizing dye forms an intramolecular salt.

2. A silver halide photographic emulsion containing in combination at least one of the sensitizing dyes expressed by the following general formula (I), at least one of the sensitizing dyes expressed by the following general formula (II) and at least one of the sensitizing dyes expressed by the following general formula (III):

General formula (I):

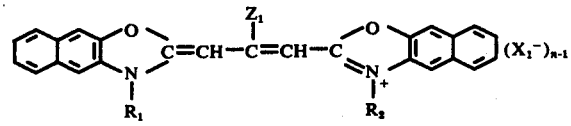

wherein $Z_1$ represents a methyl or ethyl group, $R_1$ and $R_2$ each represent an alkyl or sulfoalkyl group, $X_1^-$ represents acid anions, and n represents an integer of 1 or 2, but n is 1 when the sensitizing dye forms an intramolecular salt;

General formula (II):

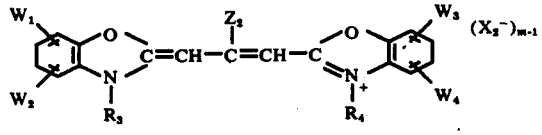

wherein $Z_2$ represents a lower alkyl group, $W_1$ and $W_2$ each represent a hydrogen or halogen atom or an alkyl group, $W_3$ and $W_4$ each represent a hydrogen or halogen atom or an alkyl, alkoxy, hydroxy or phenyl group, where $W_3$ and $W_4$ may be joined to form a benzene ring, but at least one of said $W_1$, $W_2$, $W_3$ and $W_4$ is a halogen atom, $R_3$ and $R_4$ each represent an alkyl, sulfoalkyl or carboxyalkyl group, $X_3^-$ represents acid anions, and *m* represents an integer of 1 or 2, but *m* when the sensitizing dye forms an intramolecular salt;

General formula (III):

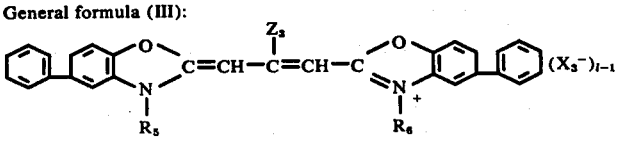

wherein $Z_3$ represents a methyl or ethyl group, $R_5$ and $R_6$ each represent an alkyl or sulfoalkyl group, $X_3^-$ represents acid anions, and 1 represents an integer of 1 or 2, but 1 is 1 when the sensitizing dye forms an intramolecular salt.

3. The silver halide photographic emulsion according to claim 1, wherein $Z_1$ and $Z_2$ each represent an ethyl group.

4. The silver halide photographic emulsion according to claim 2, wherein $Z_1$, $Z_2$ and $Z_3$ each represent an ethyl group.

5. The silver halide photographic emulsion according to claim 1, wherein the combined amount of the sensitizing dyes respectively expressed by general formulas (I) and (II) ranges from 10 to 500 mg per one mole of silver halide.

6. The silver halide photographic emulsion according to claim 2, wherein the combined amount of the sensitizing dyes respectively expressed by general formulas (I), (II) and (III) ranges from 10 to 600 mg per one mole of silver halide.

7. The silver halide photographic emulsion according to claim 1, wherein the amount ratio (by mole) of the sensitizing dyes expressed by general formulas (I) and (II) is 1 : 0.1 to 1 : 8.

8. The silver halide photographic emulsion according to claim 2, wherein the amount ratio (by mole) of the sensitizing dyes expressed by general formulas (I), (II) and (III) is (1 to 8) : (1 to 8) : (1 to 8).

9. The silver halide photographic emulsionaccording to claim 1, wherein the sensitizing dye of the general formula (I) is selected from the group consisting of

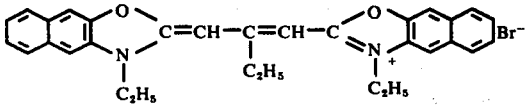

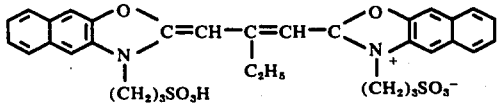

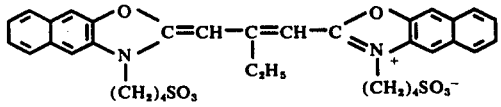

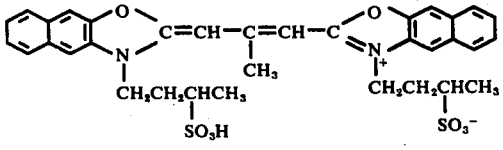

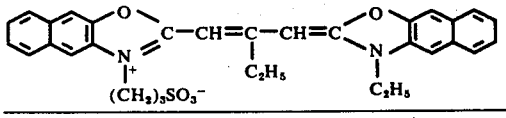

and the sensitizing dye of the general formula (II) is selected from the group consisting of

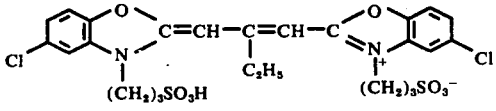

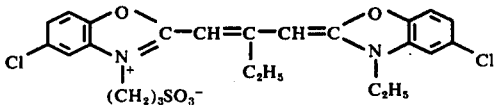

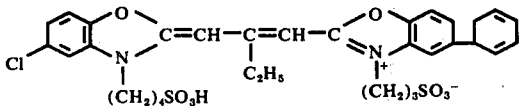

-continued

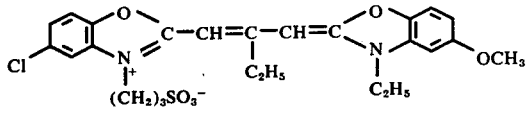

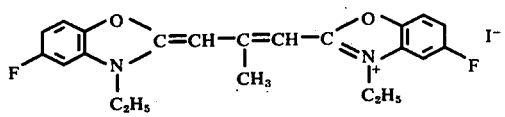

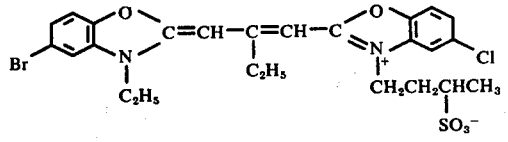

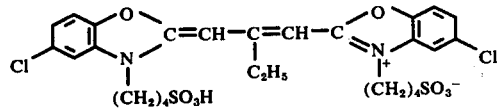

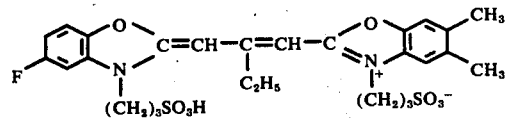

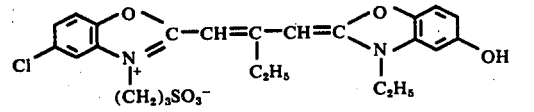

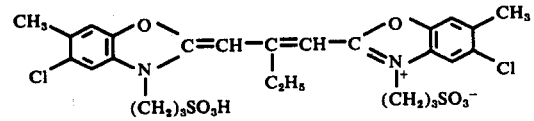

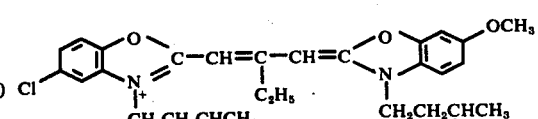

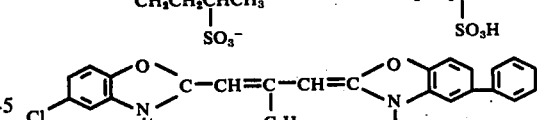

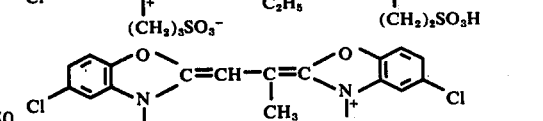

10. The silver halide photographic emulsion according to claim 2, wherein the sensitizing dye of the general formula (I) is selected from the group consisting of

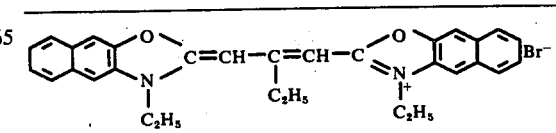

-continued

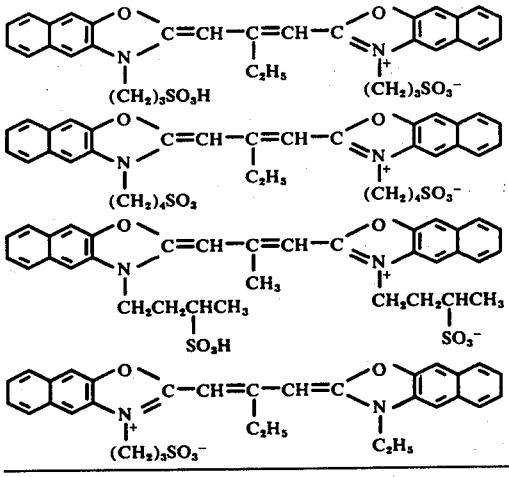

the sensitizing dye of the general formula (II) is selected from the group consisting of

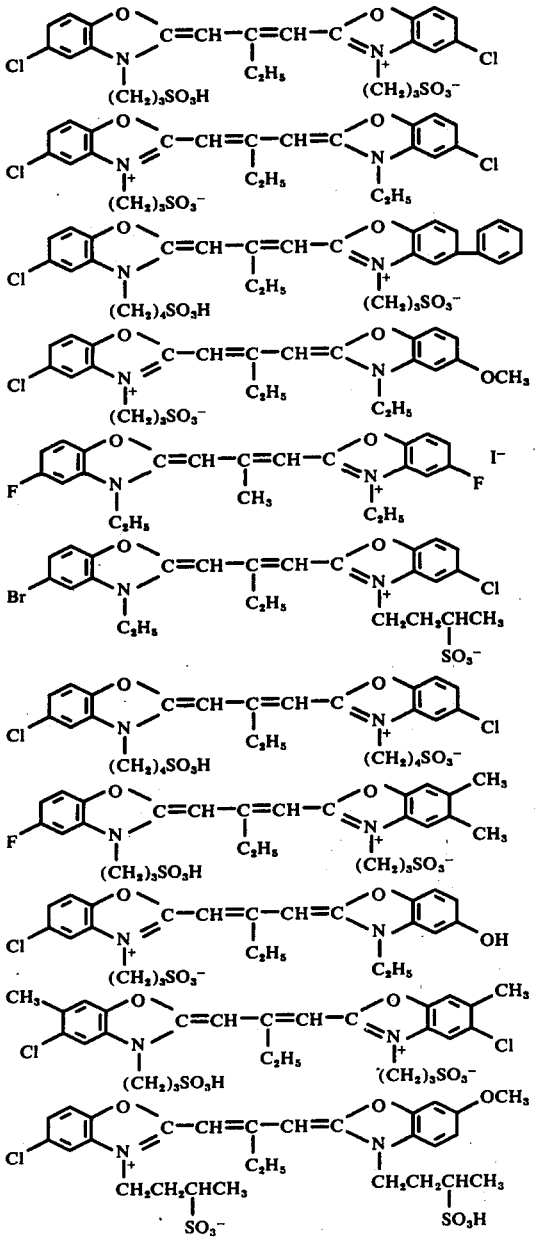

-continued

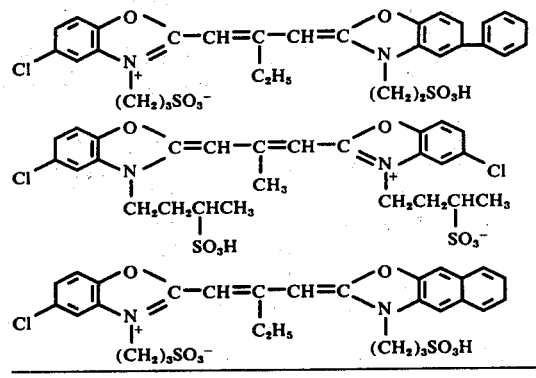

and the sensitizing dye of the general formula (III) is selected from the group consisting of

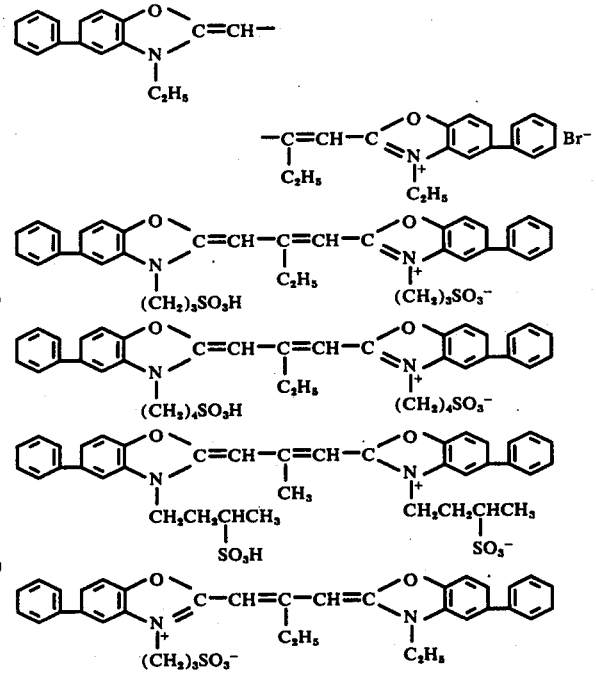

11. The silver halide photographic emulsion according to claim 1, wherein the silver halide is silver bromide, silver chloride, silver iodobromide, silver chlorobromide or silver chloroiodobromide.

12. The silver halide photographic emulsion according to claim 2, wherein the silver halide is silver bromide, silver chloride, silver iodobromide, silver chlorobromide or silver chloroiodobromide.

13. The silver halide photographic emulsion according to claim 1, wherein the emulsion contains 4-hydroxy-6-methyl-1,3,3a,7-tetrazinedene and 1-phenyl-5-mercaptotetrazole.

14. The silver halide photographic emulsion according to claim 2, wherein the emulsion contains 4-hydroxy-6-methyl-1,3,3a,7-tetrazinedene and 1-phenyl-5-mercaptotetrazole.

15. The silver halide photographic emulsion according to claim 1, wherein the emulsion contains a pyrazolone color coupler.

16. The silver halide photographic emulsion according to claim 2, wherein the emulsion contains a pyrazolone color coupler.

17. The silver halide photographic emulsion according to claim 1, wherein the emulsion contains a hydroquinone derivative.

18. The silver halide photographic emulsion according to claim 2, wherein the emulsion contains a hydroquinone derivative.

19. The silver halide photographic emulsion according to claim 1, wherein the emulsion comprises a development inhibitor releasing compound which has a 1-phenyl-5-mercaptotetrazolyl group therein.

20. The silver halide photographic emulsion according to claim 2, wherein the emulsion comprises a development inhibitor releasing compound which has a 1-phenyl-5-mercaptotetrazolyl group therein.

21. The silver halide photographic emulsion according to claim 1, wherein the emulsion contains a silver iodobromide containing iodine at a content from about 3 mole% to 8 mole%.

22. The silver halide photographic emulsion according to claim 2, wherein the emulsion contains a silver iodobromide containing iodine at a content from about 3 mole% to 8 mole%.

23. The silver halide photographic emulsion according to claim 1, wherein the emulsion is chemically sensitized with a sulfur sensitizer, a selenium sensitizer, a noble metal sensitizer or a reducing agent.

24. The silver halide photographic emulsion according to claim 2, wherein the emulsion is chemically sensitized with a sulfur sensitizer, a selenium sensitizer, a noble metal sensitizer or a reducing agent.

25. A color photographic material comprising at least one layer containing the silver halide photographic emulsion of claim 1.

26. A color photographic material comprising at least one layer containing the silver halide photographic emulsion of claim 2.

* * * * *